US005954624A

United States Patent [19]

Sandstrom

[11] Patent Number: 5,954,624

[45] Date of Patent: Sep. 21, 1999

[54] CARTON HAVING BUCKLE-CONTROLLED BRIM CURL AND METHOD AND BLANK FOR FORMING THE SAME

[75] Inventor: Erland R. Sandstrom, Menasha, Wis.

[73] Assignee: Fort James Corporation, Richmond, Va.

[21] Appl. No.: 08/892,270

[22] Filed: Jul. 14, 1997

Related U.S. Application Data

[62] Division of application No. 08/508,461, Jul. 28, 1995, Pat. No. 5,752,646.

[51] Int. Cl.[6] ..... B31B 1/28; B31B 1/44; B31B 1/74

[52] U.S. Cl. ..... 493/158; 493/328; 493/467

[58] Field of Search ..... 493/152, 158, 493/159, 328, 467

[56] References Cited

U.S. PATENT DOCUMENTS

| | | | |
|---|---|---|---|
| 2,473,836 | 6/1949 | Wixon et al. . | |
| 3,065,677 | 11/1962 | Loeser . | |
| 3,633,469 | 1/1972 | Kinney . | |
| 3,886,017 | 5/1975 | Brugh, Jr. et al. . | |
| 3,958,056 | 5/1976 | Brugh, Jr. et al. . | |
| 4,040,900 | 8/1977 | Mazzarella et al. . | |
| 4,130,234 | 12/1978 | Schmidt . | |
| 4,578,296 | 3/1986 | Miyazaki et al. . | |
| 4,606,496 | 8/1986 | Marx . | |
| 4,609,140 | 9/1986 | Van Handel . | |
| 4,680,016 | 7/1987 | Lynch . | |
| 4,721,499 | 1/1988 | Marx . | |
| 4,721,500 | 1/1988 | Van Handel | 493/152 |
| 4,832,676 | 5/1989 | Johns | 493/152 |
| 5,029,749 | 7/1991 | Aloisi | 493/158 |
| 5,078,273 | 1/1992 | Kuchenbecker | 493/63 |
| 5,184,995 | 2/1993 | Kuchenbecker . | |
| 5,203,491 | 4/1993 | Marx | 493/152 |
| 5,242,497 | 9/1993 | Miller . | |
| 5,326,020 | 7/1994 | Cheshire . | |
| 5,393,337 | 2/1995 | Nakamura et al. . | |
| 5,431,619 | 7/1995 | Bacon et al. . | |
| 5,472,402 | 12/1995 | Aloisi | 493/158 |
| 5,524,817 | 6/1996 | Meier . | |
| 5,544,808 | 8/1996 | Aloisi . | |
| 5,556,364 | 9/1996 | Konzai | 493/109 |
| 5,571,224 | 11/1996 | Aloisi . | |
| 5,637,332 | 6/1997 | Ridout . | |
| 5,729,914 | 3/1998 | Aloisi . | |
| 5,752,646 | 5/1998 | Sanstrom | 493/158 |

OTHER PUBLICATIONS

The Wiley Encyclopedia of Packaging Technology, John Wiley & Sons, (1986) pp. 2, 3, 500, 501, 620, 621.

*Primary Examiner*—James F. Coan
*Assistant Examiner*—Gene L. Kim
*Attorney, Agent, or Firm*—Sixbey, Friedman, Leedom & Ferguson; Charles M. Leedom, Jr.; Donald R. Studebaker

[57] ABSTRACT

A paperboard container and method of forming such container having a rolled brim is disclosed. The container being formed of a paperboard material having a caliper of at least approximately 0.007 inches, a rolled brim arc length of less than about 0.25 inches, an outer radius of curvature of the container cut through the plane normal to the axis of the rolled brim arc length adjacent the rolled brim being less than approximately 1.5 inches with the paperboard material forming the container having at least approximately 8 lbs/3,000 $ft^2$ ream of size press adhesive included therein and preferably approximately 13 lbs/3,000 $ft^2$ ream of paperboard material. One particular container includes dimensions wherein the outer radius of curvature of the container cut through the plane normal to the axis of the rolled brim arc length adjacent the rolled brim is approximately 1.25 inches while an inner radius of curvature of the container cut through the plane normal to the axis of the rolled brim arc length adjacent the rolled brim is at least 1.09 inches. Such a container is formed by initially providing a paperboard shell formed from a paperboard blank having an unfinished annular exposed edge; directing the unfinished annular edge into a forming surface of a forming die; urging the unfinished annular edge into the forming die and controlling an initial buckling point of the unfinished annular edge of the paperboard shell such that a substantially defect free prolate rolled toroidal brim is formed.

13 Claims, 8 Drawing Sheets

FIG. 1A
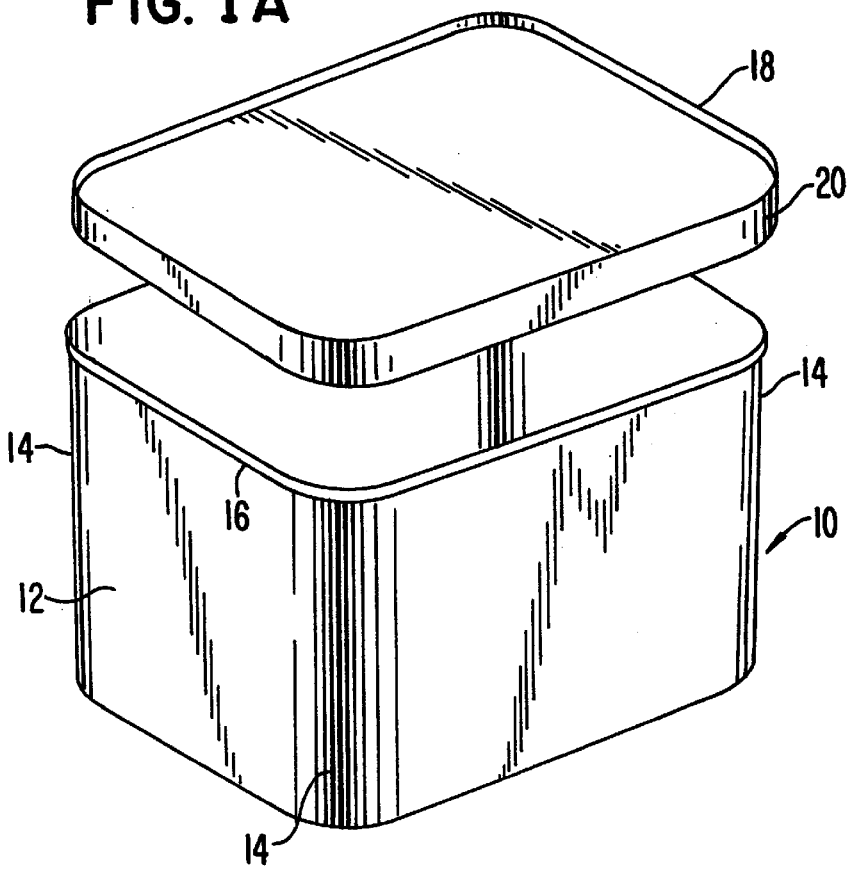
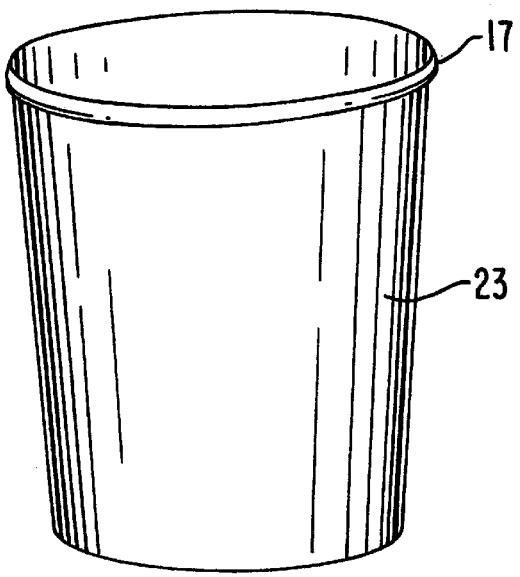
FIG. 1B

CARTON HAVING BUCKLE-CONTROLLED BRIM CURL AND METHOD AND BLANK FOR FORMING THE SAME

This is a Divisional application of Ser. No. 08/508,461, now U.S. Pat. No. 5,752,646, filed Jul. 28, 1995.

TECHNICAL FIELD OF THE INVENTION

The present invention relates to a canister type carton having a curled brim region. More particularly, the present invention relates to a canister type carton having a buckle-controlled brim curl, a method of forming such buckle-controlled brim curl as well as a paperboard blank used to form such carton.

BACKGROUND OF THE INVENTION

Various types of containers from drinking cups to elongated canisters have been manufactured over the years with rolled brims about an upper periphery thereof. Such rolled brims or brim curls as they are often referred to in the art serve both structural as well as aesthetic functions which are critical to the acceptance of such containers by the consumer.

Initially, it is imperative that a consumer oriented product be aesthetically pleasing to the consumer both visually as well as functionally. That is, a drinking cup or canister having a sharp, bare upper edge would not be readily accepted by the consumer. Such a rim is not visually pleasing to the consumer nor is such a rim comfortable for the consumer during use. Further, such a container is not structurally sound and could readily collapse when handled by the consumer. Additionally, with canister type containers having lids placing thereon, not only may the lid readily slip off over a sharp, bare upper edge, the seal between the lid and canister is not reliable.

The rigidity of a particular container is effected by the tensile and bending stress in both the vertical and circumferential directions of the container. As noted hereinabove, one expedient for increasing the rigidity of a paper container is to form a brim about the top of the container. As is disclosed in U.S. Pat. No. 2,473,836 issued to Vixen et al., conventional brim curling mechanisms utilize complimentary curved dies in which the lower die is first moved upwardly around the upper end of the cup to the top edge of the cup where it firmly holds the cup top. The upper die is then moved downwardly to engage the uppermost edge of the cup between the dies with both of the dies then moving downwardly together to curl the upper edge of the container thereby forming a brim. This brim adds significantly to the rigidity of the overall cup structure.

U.S. Pat. No. 3,065,677 issued to Loeser discloses a similar brim curling mechanism for containers. A lower die having a curve forming upper surface is maintained stationary while an upper die having a curve forming lower surface descends downwardly toward the stationary lower die, deflecting the upper edge portion of the container secured by the lower die and again forming a brim about the upper periphery of the container. This brim, as stated previously, adds significantly to the overall rigidity of the container.

Containers of the above-mentioned type can be readily manufactured at relatively high speeds using conventional brim curl forming equipment by forcing an unfinished annular edge into a die which curls the brim outwardly forming a roughly elliptical toroidal rim. As is noted in U.S. Pat. No. 5,029,749, the orientation of the blank used in forming such containers may also aid in the manufacture of containers having brim curls formed thereon by reducing defects found in the brim curls. However, when manufacturing containers where either the paperboard stock material is relatively heavy and/or the radius of curvature of the annular edge to be rolled is relatively small, cracks often appear in the outer surface of the toroidal brim. Clearly, such cracks degrade the appearance of the rolled brim and can often degrade the functionality of the rolled brim particularly when the brim is to sealingly receive a lid thereon.

In an effort to overcome the above-noted shortcomings, pretreating at least the annular edge of the paperboard shells with steam has been introduced as exemplified in U.S. Pat. No. 5,472,402 to Aloisi et al. and assigned to the assignee of the subject invention. Therein, the shells are housed in a steaming unit prior to their final formation such that at least the annular edge region is moistened which permits the brim curl to be more readily and reliably formed. While such a unit aids in the formation of the container, the cost of such a unit as well as the expense of operating and maintaining such a unit are an added expense to the overall cost of each container.

In view of the foregoing, there is clearly a need for a container that can be reliably manufactured at high speeds which exhibits an annular edge having relatively small radius of curvature and/or which is formed of a relatively heavy paperboard material having a brim curl which is substantially defect free.

SUMMARY OF THE INVENTION

The primary object of the present invention is to overcome the aforementioned shortcomings associated with the prior art containers.

Another object of the present invention is to provide a container having a brim curl formed about a portion of the container having a relatively small radius without the formation of cracks in an outer surface of the brim curl.

Yet another object of the present invention is to provide a container formed from a blank having a relatively high thickness when compared to similar prior art paperboard containers.

A still further object of the present invention is to provide a canister type container wherein defects formed in the brim curl of the container are minimized.

Yet another object of the present invention is to form a canister type carton from paperboard material impreganented with sizing adhesive in an amount equivalent to from about at least 8 to about 20 lbs/3000 $ft^2$ ream of paperboard material, and preferably in an amount equivalent to approximately 13 lbs. of sizing adhesive per 3,000 $ft^2$ ream of paperboard material.

A further object of the present invention is to provide a method of forming a paperboard container wherein an initial buckling point of the paperboard shell being subjected to a brim curl process is controlled so as to produce a substantially defect free brim curl.

A still further object of the present invention is to provide a paperboard shell for forming a container having paperboard characteristics which aid the paperboard shell in its travel into a forming die such that the initial buckling point of the paperboard shell occurs a substantial distance into the annular edge so as to form substantially defect free brim curls on containers having relatively small radius of curvature at the brim curl.

These as well as additional objects of the present invention are achieved by providing a paperboard container having a rolled brim with the container being formed of a paperboard material, a rolled brim arc length of less than about 0.25 inches, an outer radius of curvature cut through the plane normal to the axis of the rolled brim arc length of the container adjacent the rolled brim being less than approximately 1.5 inches with the paperboard material forming the container having at least approximately 8 lbs/3,000 $ft^2$ ream of size press adhesive included therein and preferably approximately 13 lbs/3,000 $ft^2$ ream of paperboard material. One such container includes particular dimensions wherein the outer radius of curvature cut through the plane normal to the axis of the rolled brim arc length of the container adjacent the rolled brim is approximately 1.25 inches while an inner radius of curvature cut through the plane normal to the axis of the rolled brim arc length of the container adjacent the rolled brim is at least 1.09 inches. In this embodiment, the side wall of the container is substantially vertical and a major diameter of the rolled brim is approximately 0.14 inches while a minor diameter of the rolled brim is approximately 0.125 inches.

The aforementioned container is formed by providing a paperboard shell having an unfinished annular exposed edge; directing the unfinished annular edge into a forming surface of a forming die; urging the unfinished annular edge into the forming die and controlling an initial buckling point of the unfinished annular edge of the paperboard shell such that a substantially defect free prolate rolled toroidal brim is formed. In the embodiment illustrated in FIG. 1A, the buckling point of the unfinished annular edge of the paperboard shell initiates a distance from about 4 to about 8 times the caliper of the paperboard shell from the unfinished annular edge. In all other containers manufactured in accordance with the present invention, the distance may be defined as from about 25% to about 50% of the arc length of the rolled brim to be formed from the unfinished annular edge.

In order to aid in the formation of the prolate rolled toroidal brim, a lubricant is provided on one of either the paperboard shell or forming surface of the forming die which allows the unfinished annular edge of the paperboard shell to travel further along the forming surface before the buckling of the unfinished annular edge is initiated. This may be achieved by applying a lubricating agent to the paperboard blank prior to forming the paperboard shell, applying the lubricating agent to the paperboard shell, or applying the lubricating agent to the forming surface of the forming die. Preferably, the lubricating agent is added to a polyethylene coating which is applied to the paperboard material.

These as well as additional advantages of the present invention will become apparent from the following detailed description when read in light of the several figures.

BRIEF DESCRIPTION OF THE DRAWINGS

FIG. 1A is a perspective view of one type of container which benefits from being formed in accordance with the present invention.

FIG. 1B is a perspective view of another type of container which benefits from being formed in accordance with the present invention.

DETAILED DESCRIPTION OF THE INVENTION

The present invention will now be described in detail with reference to the several figures.

Figure 10:
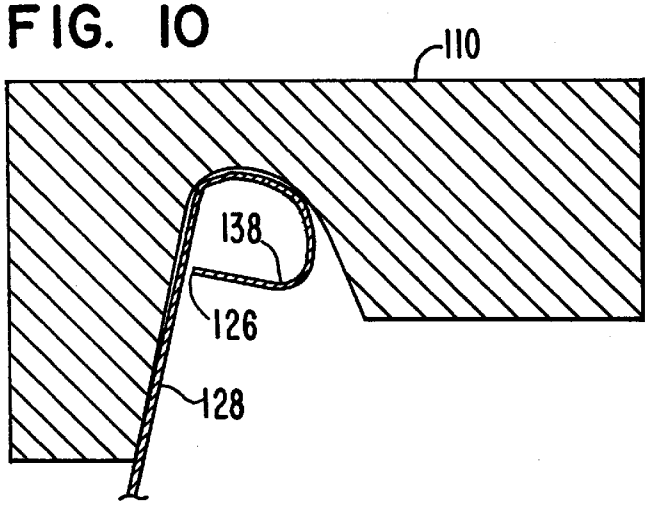
FIG. 10 is a schematic representation of the brim curl formed illustrating the completion of the rolled brim as it completes engagement with the concave upper-toroidal surface of the die.
Figure 7:
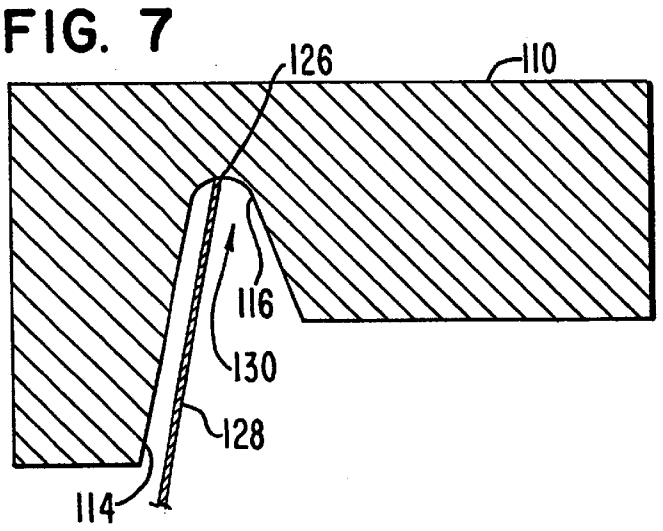
FIG. 7 is a schematic representation of a brim curl being formed illustrating the unfinished annular edge of the container entering the brim curl forming die at the point of engagement with the concave upper-toroidal surface of the die.
Figure 9:
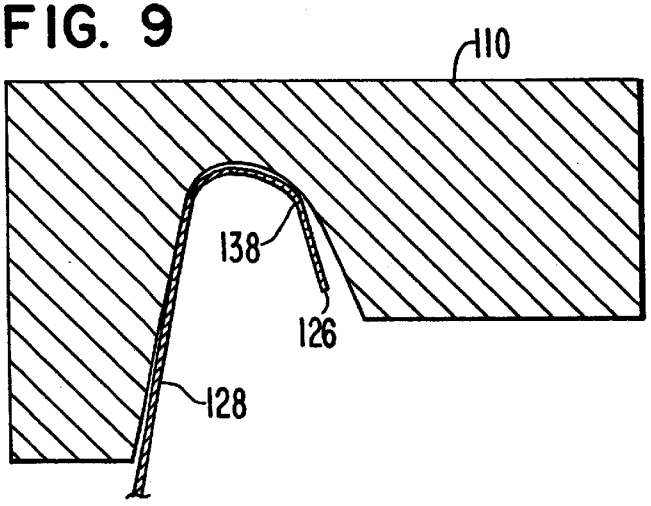
FIG. 9 is a schematic representation of the brim curl being formed illustrating initial curling of the rolled brim as it is further urged into engagement with the concave upper surface of the die.

Initially, reference is made to FIG. 1A wherein a container 10 of the canister type having a substantially vertical side wall 12 is illustrated. This container being one type of container which benefits from being formed in accordance with the present invention. As can be seen from FIG. 1A, the container 10 includes rounded corners 14, the particular dimensions of which will be described in greater detail hereinbelow. About an upper periphery thereof is a rolled brim or brim curl 16. In the type of container illustrated in FIG. 10, the brim curl is provided in order to add stability to the container as well as allow the container to readily receive and form sealing engagement with a cooperating lid 18. The lid includes similar rounded corners and a substantially vertical side wall 20 which frictionally engages the brim curl 16 of the container 10. As mentioned hereinabove, the container 10 is of the canister type and readily receives flowable products such as ice cream, frozen yogurt, sugar, flour, or similar type granular products. Once in place, due to the frictional engagement of the lid with the brim curl 16, the lid requires some jarring in order to remove the lid from the canister. In this regard, it is imperative that the brim curl 16 be substantially defect free in order to form a substantially continuous seal between the canister 10 and lid 18.

Figure 2A:
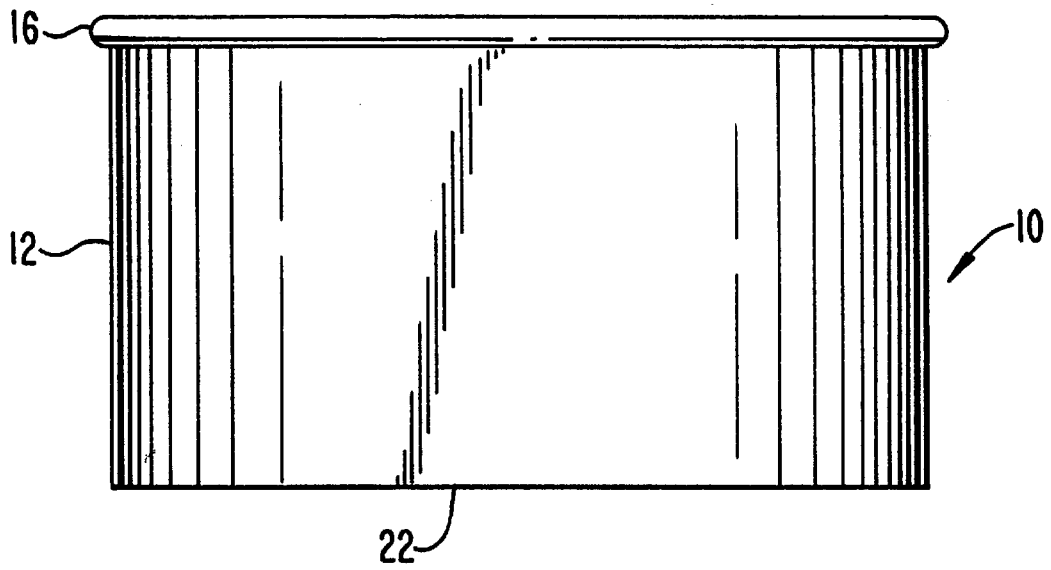
FIG. 2A is a side elevational view of the container illustrated in FIG. 1A.

Referring now to FIG. 2A, the brim curl 16 formed about an upper periphery of the container 10 is readily illustrated.

Further, the substantially vertical side walls 12 which extend upwardly from a substantially planar bottom 22 of the container 10 is readily illustrated. It should be noted that while the present invention is described with reference to the particular container 10 illustrated in FIGS. 1A, 2A and 3A, the underlying concepts set forth hereinbelow may be readily applied to any paperboard containers having a circular, elliptical, or other curvilinear type opening wherein it is desired to for substantially defect free brim curls about an upper periphery of the container.

Figure 3A:
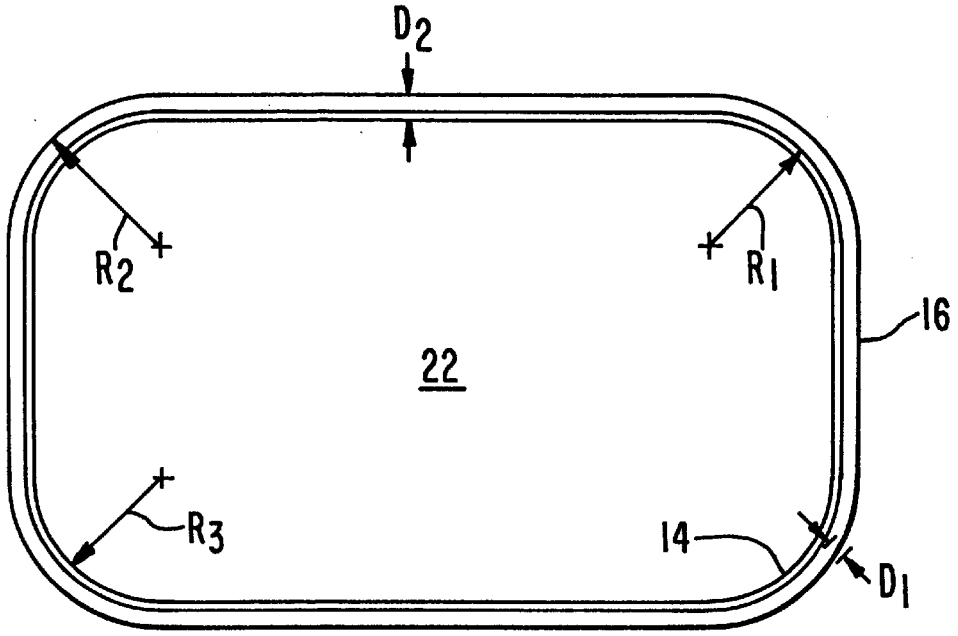
FIG. 3A is a top view of the container illustrated in FIG. 1A.

With the particular container illustrated in FIGS. 1A, 2A and 3A, the corners 14 have an inner radius $R_1$ cut through the plane normal to the axis of the rolled brim arc length of approximately 1.094 inches where the brim curl begins and an outer radius at the outer periphery of the brim curl $R_2$ cut through the plane normal to the axis of the rolled brim arc length of approximately 1.250 inches. In this regard, the diameter of the brim curl $D_1$ at the curved corners 14 is approximately 0.125 inches while the diameter of the brim curl $D_2$ along a length of the container is approximately 0.156 inches. It is the diameter of the brim curl along the curvilinear regions 14 which is critical and the essence of the present invention.

As is illustrated in FIG. 3A, the bottom 22 of the container is of a smaller dimension than the top and includes a radius region $R_3$ cut through the plane normal to the axis of the rolled brim arc length equal to approximately 1.034 inches. While the side walls 12 of the container are substantially vertical, it is necessary that such walls taper inwardly slightly thereby providing a bottom wall 22 having a smaller dimension than the top of the container such that the containers when stacked one upon the other will telescope into one another thereby reducing the overall height of the stack for storage and transportation purposes. Again, forming the brim curl along the elongated regions of the container occur substantially without fault. However, as can be appreciated by those skilled in the art, it is at the corners in the curved regions 14 where the paperboard material forming the brim curl is stressed which can often result in the cracking of the outer parameter of the brim curl.

Figure 2B:
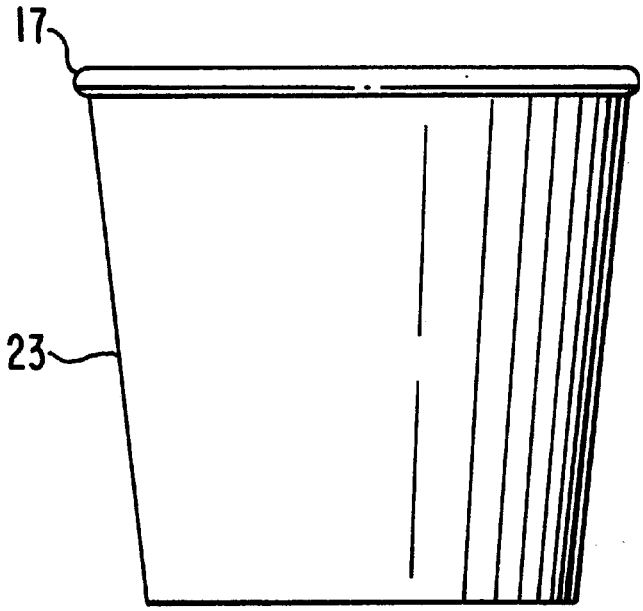
FIG. 2B, is a side elevational view of the container illustrated in FIG. 1B.
Figure 3B:
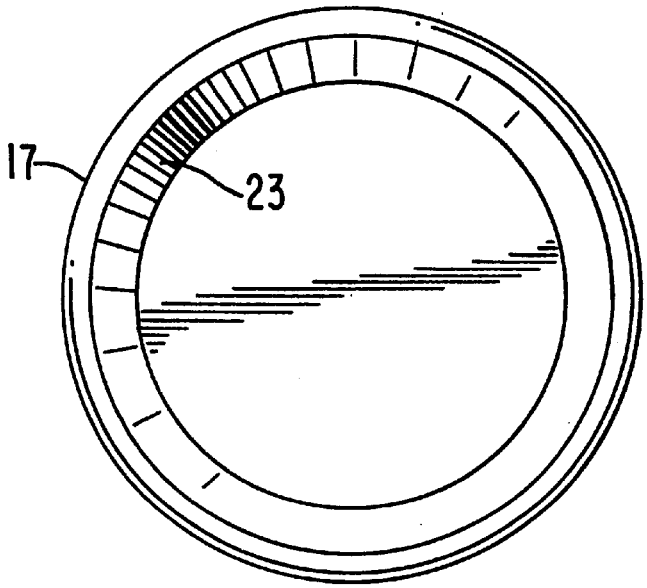
FIG. 3B is a top view of the container illustrated in FIG. 1B.

As noted hereinabove, drinking cups having a relatively small radius of curvature at the opening benefit from forming the brim curls in accordance with the present invention. Cups of this type have a paperboard shell thickness of approximately 0.007 inches and when formed include a brim curl 17 and slightly angled side walls 23 as illustrated in FIGS. 1B, 2B and 3B. As discussed previously, when forming brim curls on containers where the portion of the container is of a small radius of curvature, the resultant stress on the paperboard shell is great, resulting in cracks and other noticeable defects in the outer surface of the brim curl. Accordingly, by forming such brim curls in accordance with the present invention reduces and substantially eliminates such defects.

Figure 4:
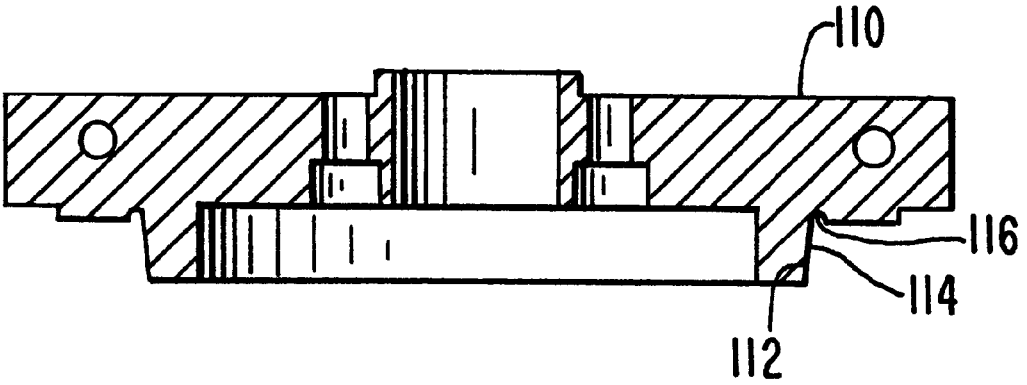
FIG. 4 is a cross-sectional view of an upper tool die for forming a brim curl on the container illustrated in FIG. 1.
Figure 5:
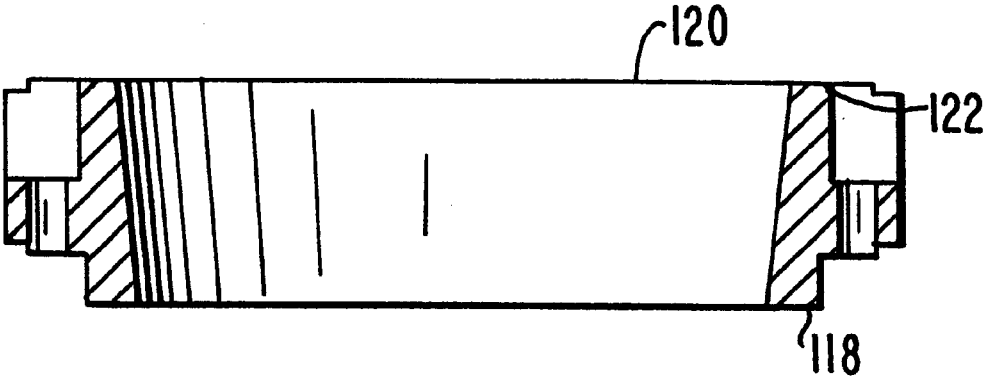
FIG. 5 is a cross-sectional view of a lower tool die for forming the brim curl on the container illustrated in FIG. 1.

Referring now to FIGS. 4 and 5, the brim curls formed in either of the containers illustrated in FIGS. 1–3 are formed by a die arrangement which is heretofore described in detail in U.S. Pat. No. 5,029,749 issued to Aloisi et al. and discussed hereinabove and will only be described briefly in connection with the subject invention. The particular die arrangement for forming the brim curl 16 or 17 about an upper periphery of the container illustrated in FIGS. 1–3 includes an upper or male die 110 which may be manipulated by conventional brim forming devices such as those illustrated in U.S. Pat. Nos. 2,473,836 and 3,065,677 discussed hereinabove. The upper die 110 includes a lower surface having a flange 112 extending axially therefrom thereby providing a slanted outer surface 114 and an undercut 116, the significance of which will be described in greater detail hereinbelow. The lower or female die 118 illustrated in FIG. 5 includes an axial bore 120 which receives a container shell formed from paperboard material. The bore 120 being of the same configuration as that of the container itself with an unfinished annular edge of the container extending from the die 118. Also formed in the die 118 is a channel 122 which receives the paperboard material during a formation of the brim curl 16 or 17.

Referring now to FIGS. 7–10, a schematic illustration of the brim curl being formed in accordance with the present invention will be described in greater detail. Schematically illustrated in each of FIGS. 7–10 is the upper die 110 which includes the elongated surface 114 as well as the concaved forming surface 116. It has been determined in accordance with the present invention that it is desirable that the unfinished annular edge 126 of the paperboard shell 128 which is to form the container as illustrated in FIG. 1–3 extend into the forming region 130 of the die 110 as far as practical before initial buckling of the paperboard material takes place. It has been determined that many of the flaws and defects presently experienced in containers of this type can be alleviated by controlling the initial buckling point of the paperboard material and assuring that this initialling buckling point is spaced from the unfinished annular edge by a distance of at least 25% of the arc length of an elliptical toroidal surface which forms the brim curl surface.

Figure 6B:
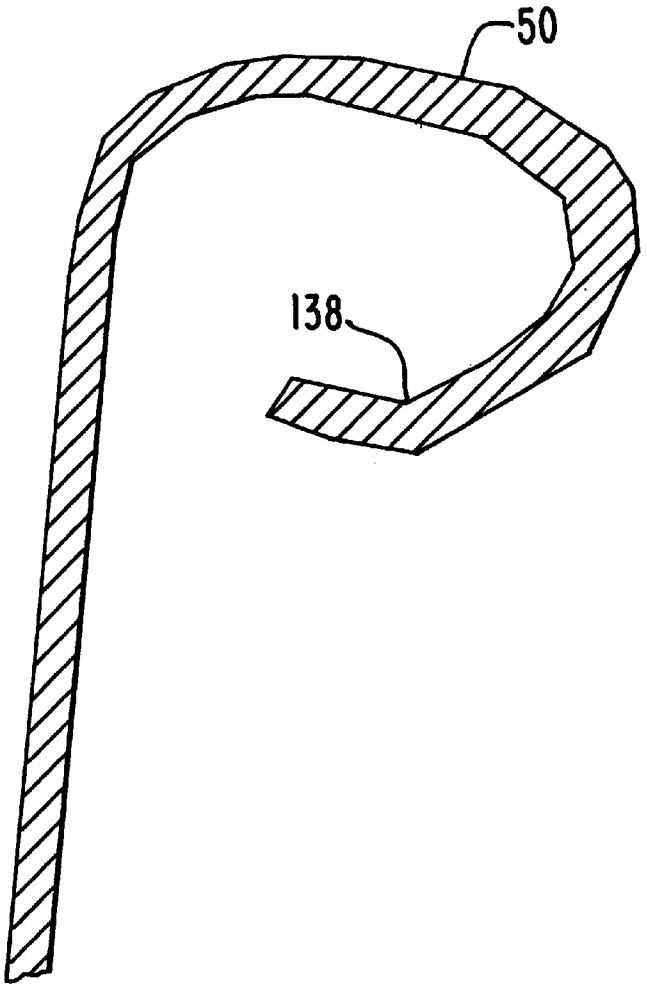
FIG. 6B is a schematic representation of a brim curl not formed in accordance with the present invention which would exhibit defects in the exterior surface thereof.

The elliptical toroidal surface being the surface formed by revolving an ellipse around a line spaced therefrom, this being the brim curl itself. In this regard, the elliptical toroid or brim curt can be classified into classes, an oblate toroidal surface or a prolate toroidal surface. With reference to FIG. 6B, an oblate toroidal surface is defined as the surface resulting when the flattened exterior portion of the ellipse 50 is closer to perpendicular to the line about which the elliptical toroidal surface is revolved. On the other hand, with reference to FIG. 6A, a prolate toroidal surface is formed when the flattened exterior portion 50 of the ellipse is closer to parallel to the line about which the elliptical toroidal surface is revolved. The two classes are divided by a line at about 45° with respect to the line about which the elliptical toroidal surface, that is a surface where the flattened exterior surface 50 extends at an angle less than 45° with respect to the center line, is revolved. Those brim curls closely approximating a prolate toroidal surface, that is a surface where the flattened exterior surface 50 extends at an angle less than 45° with respect to the center line exhibit little, if any, failures while those brim curls more closely exhibiting an oblate elliptical toroidal surface or a surface extending at an angle greater than 45° with respect to the center line, generally include numerous failures.

Figure 6A:
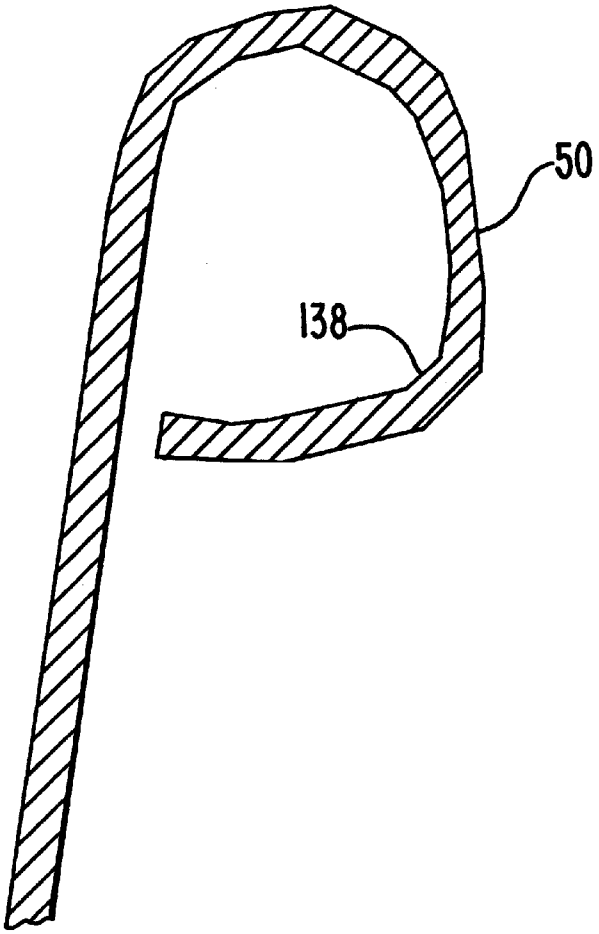
FIG. 6A is a schematic representation of a brim curl formed in accordance with the present invention which would be substantially defect free.
Figure 8:
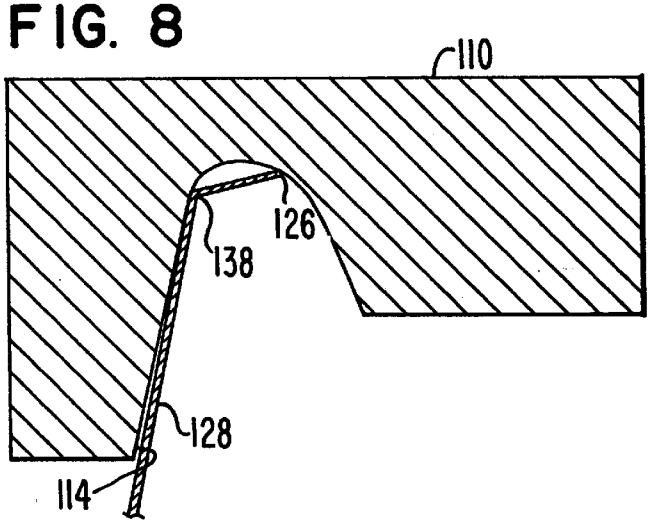
FIG. 8 is a schematic representation of the brim curl being formed illustrating initial buckling of the unfinished edge as it is urged into engagement with the concave upper surface of the die.

Returning again to FIGS. 7–10, once the leading edge 126 of the paperboard carton shell contacts the concave forming surface of the die 110, the paperboard shell is urged into the die as far as possible before an initial buckling at 138 occurs in the paperboard material as illustrated in FIG. 8. Once the initial buckling of the paperboard material takes place, continued urging of the paperboard material into the forming die 110 will form a completed brim curl about an upper periphery of a container as illustrated with reference to FIGS. 8, 9 and 10. By controlling the initial buckling of the paperboard material, a more desirable prolate brim curl, as illustrated in FIG. 6A can be achieved. If the initial buckling point of the paperboard material is less than the predetermined position, an oblate type brim curl which results in cracks in an outer periphery of the brim curl as illustrated in FIG. 6B is formed as discussed hereinabove. As has been discovered in accordance with the present invention, it is desired that the initial buckling position of the unfinished annular edge of the paperboard shell for the container illustrated in FIG. 1A be a distance of from about 4 to about 8 times the caliper of the paperboard shell from the unfinished edge. Otherwise stated, and particularly for containers similar to that illustrated in FIG. 1B, the initial buckling position of the unfinished annular edge of the paperboard shell should initiate a distance from about 25% to about 50% of an arc length of the rolled brim to be formed from the unfinished annular edge. In the particular embodiment illustrated With respect to FIG. 1A, the arc length of the brim curl formed in accordance with the present invention is approximately 0.25 inches. Therefore, it is desired that the initial buckling position be from 0.0625 inches to 0.125 inches from the unfinished annular edge or with a paperboard shell having a caliper of 0.0235 inches, the optimum initial buckling position would be 0.094 to 0.188 inches. Again, these values are set forth by way of example and the particular initial buckling position of the unfinished annular edge of the paperboard shell would be dependent upon the desired brim curl to be formed as well as the caliper of the paperboard material being used.

In accordance with the preferred embodiment of the subject invention, the paperboard stock material which is used in forming the container illustrated in FIGS. 1–3 is preferably impreganented with sizing adhesives in an amount equivalent to from about at least 8 to about 20 lbs/3,000 $ft^2$ ream of paperboard material and preferably in the amount equivalent to approximately 13 lbs of sizing adhesive per 3,000 $ft^2$ ream of paperboard maternal. The sizing adhesives suitable for use in the present invention include those materials commonly applied to paperboard which serve to stiffen the board. Typical sizing adhesives include polyvinyl alcohol, carboxymethyl cellulose, naturally occurring gums, sodium silicate, polyvinyl acetate, styrene butadiene, starches and the like as well as various combinations of these materials. For economical reasons, starches are the preferred sizing adhesive for use in connection with the present invention. In addition to sizing adhesive, the paperboard material may be impreganented with pigments in the from of clay and the like. In this regard, it is preferred that the amount of pigmentation material not exceed more than 50% of the total sizing adhesive being applied to the paperboard material.

After further studies, it has been determined that various parameters affect the buckling resistance of the paperboard material. From this, it has been determined that the main factors affecting the buckling resistance of the container, which can be readily controlled during the manufacture of the paperboard material are the Z direction tensile strength of the paperboard material, the amount of wood pulp fiber and its character within the board, the caliper of the paperboard material, the moisture content of the paperboard material, the amount of sizing adhesive applied to the paperboard material as well as the addition of a lubricant to the paperboard material. In this regard, it is noted that increasing the Z direction tensile strength of the paperboard material increases the buckling resistance of the paperboard material. However, when increasing the Z direction tensile strength to high levels which are required in order to significantly effect the buckling resistance, the productivity of the board machine forming the paperboard material is significantly reduced. Therefore, as is best illustrated in the following Table, a compromise between the increase in size press weight and increase in Z direction tensile strength results in little or no failures in the brim curls while allowing for high productivity.

KEY VARIABLES CONTROLLING TOP CURL FAILURES IN CONTAINERS

| Grade | Effect of Steam, Lubricant and Buckling Resistance | How Buckling Resistance Was Improved | Failures (1) | Steam (2) | Polyethylene Lubricant (3) | Buckling Resistance (4) | Cross Machine Stretch % | Z Direction Tensile PSIG | Size Coat Wght lb/R |
|---|---|---|---|---|---|---|---|---|---|
| $A_1$ | | | 5.03 | no | no | 166 | 6.2 | 40 | 9 |
| $A_2$ | Steam | | 1.42 | yes | no | 166 | 6.2 | 40 | 9 |
| $B_1$ | Buckling Resistance | Increased Size Press Weight | 1.71 | no | no | 199 | 5.6 | 38 | 13 |
| $B_2$ | Steam + Buckling Resistance | | 0.48 | yes | no | 195 | 5.5 | 35 | 13 |
| $B_3$ | Lubricant + Buckling Resistance | | 0.09 | no | yes | 188 | 5.9 | 44 | 13 |
| $B_4$ | Buckling Resistance | Increased Size Press Weight | 0.06 | no | no | 208 | 6.1 | 48 | 13 |
| $B_5$ | Lubricant + Buckling Resistance | and Moderate ZDT Increase | 0 | no | yes | 197 | 6.1 | 49 | 13 |
| $C_1$ | Buckling Resistance | Large Increase in ZDT | 0.14 | no | no | 198 | 6.9 | 55 | 7.5 |
| $C_2$ | Lubricant + Buckling Resistance | | 0 | yes | no | 198 | 6.9 | 55 | 7.5 |

Referring to the above-noted table, three different grades of paperboard material were tested with the results of such tests set forth therein. The first sample being that having a size press coat weight of approximately 9 lbs/3,000 $ft^2$ ream and a Z direction tensile strength of approximately 40 lbs per square inch. As noted therein, without the use of steam, a significant number of failures were evidenced, however, with the use of steam, these failures are reduced significantly. As noted hereinabove, the use of steam adds to the production costs of manufacturing such containers. When the Z direction tensile strength of the paperboard material is increased significantly as exhibited in grade C, the failures are significantly reduced, however, again, as mentioned hereinabove, large increases in Z direction tensile strength result in a decrease in the productivity of the board machine forming the paperboard material.

As is evidenced by the grade B trials, an increase in sizing adhesives results in a decrease in failures observed in the trials. As further evidenced by trials $B_4$ and $B_5$, with the combination of increased size press weight and a moderate increase in Z direction tensile strength the noted failures are substantially eliminated.

The paperboard material is coated with a useful coating polymer prior to formation of the paperboard shells used in forming the containers in accordance with the present invention. Polymers suitable for this purpose are polymers comprising carbon and hydrogen moieties or carbon, hydrogen and oxygen moieties having a melting point below 270° C. and having a glass transition temperature ($T_g$) in the range of −150° to +120° C. The preferred polymer is a low density polyethylene for containers similar to that illustrated in FIG. 1A and a high density polyethylene for cups such as that illustrated in FIG. 1B.

As noted hereinabove, an additional means in aiding in the passing of the paperboard material into the forming die is the addition of a lubricant to the polyethylene coating which is applied to the paperboard material. In the trials set forth hereinabove, the lubricant added to the polyethylene was glycerol monostearate, however, any known lubricant may be used to accomplish the same goals. By adding such lubricant, the leading edge of the paperboard material will not be prematurely caught in the forming die and thus permitted to pass completely into the forming die before the initial buckling takes place. It should also be noted that a lubricant may also be applied to the forming die itself.

In conventional containers, polyethylene coating is applied to the paperboard material by way of an extruder and it is imperative that the polyethylene coating adhere to the paperboard material. To this end, one of three methods are generally used. These being one of a corona treatment, flame treatment or polyethylene imine treatment better known in the art as a PEI treatment. However, it has been found, in accordance with the present invention that with the addition of a lubricant as discussed hereinabove, one such process is not sufficient to adhere the polyethylene coating to the paperboard material. Therefore, the paperboard material is subjected both a PEI treatment and a flame treatment in accordance with the present invention. This allows the lubricant containing polyethylene coating to adhere to the paperboard material resulting in a paperboard shell which passes further into the forming die when urged thus aiding in the control of the initial buckling point during formation of the brim curl in accordance with the present invention. This is achieved in that the use of the lubricant reduces the coefficient of friction of the surface of the paperboard material as well as reduces any static charge build up during handling of the paperboard material.

Figure 11:
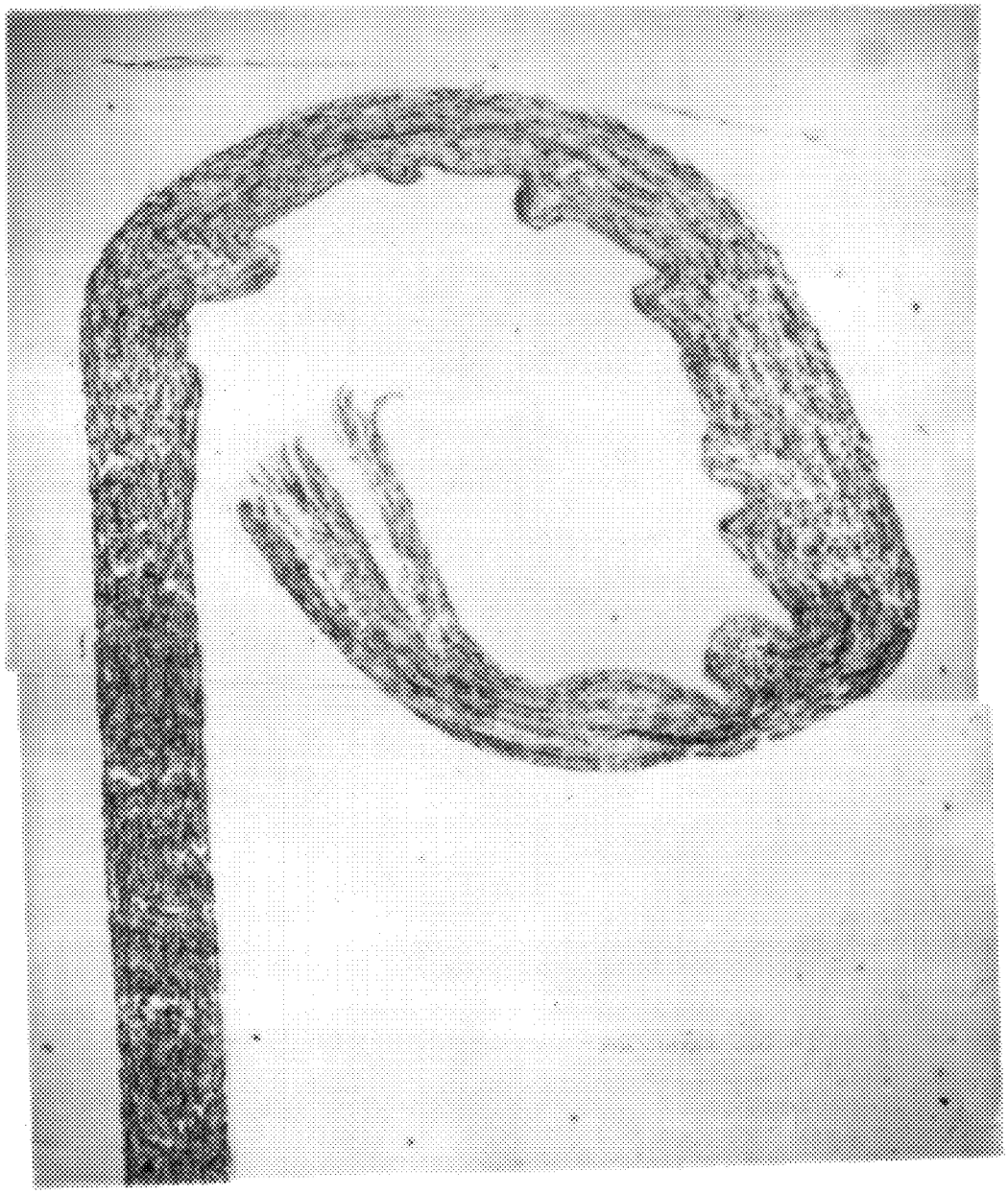
FIG. 11 is a composite photomicrograph of a section of a prolate rolled brim of a container formed in accordance with the present invention.
Figure 12:
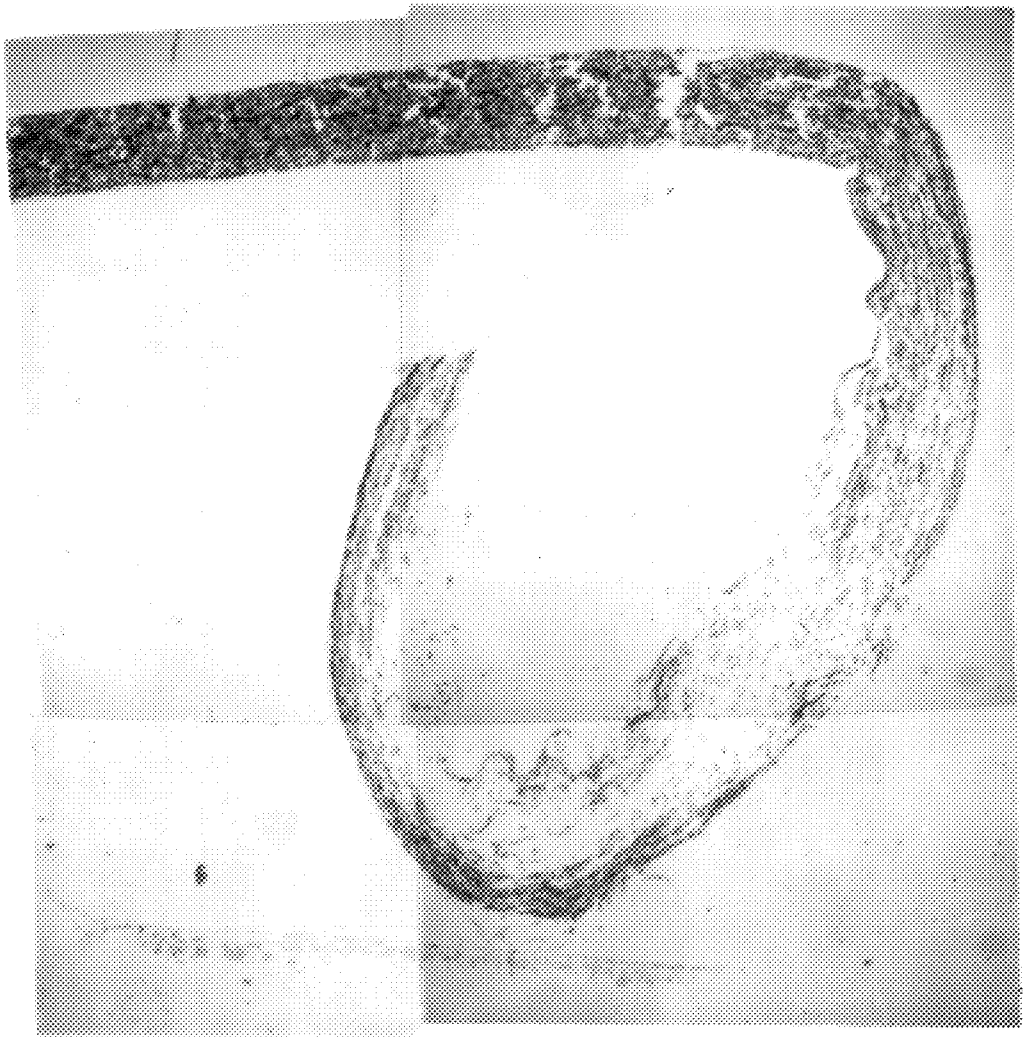
FIG. 12 is a composite photomicrograph of a section of an oblate rolled brim of a container not in accordance with the present invention which when examined exhibits cracking on the exterior peripheral surface thereof.

Referring now to FIGS. 11 and 12, photomicrographs of two brim curls formed utilizing conventional forming dies are illustrated wherein the caliper of the paperboard material used in each of the samples is identical. With the sample illustrated in FIG. 11, the paperboard material included approximately 13 lbs/3,000 $ft^2$ ream of sizing adhesive wherein it can be noted that the initial buckling point of the paperboard material is on the order of 4 to 8 times that of the caliper of the material for containers such as that illustrated in FIG. 1A or 25% to 50% of the arc length of the elliptical toroidal surface being formed. Unlike the sample illustrated in FIG. 11, the brim curl formed on the sample illustrated in FIG. 12 includes an initial buckling point which is less than 25% of the arc length of the elliptical toroidal surface and less than 4 times that of the caliper of the paperboard material. Again, while the caliper of the paperboard material in each of the samples is identical, the sizing adhesive added to the sample set forth in FIG. 11 is significantly greater than that of the sample set forth in FIG. 12. In this regard, as set forth in accordance with the present invention, the unfinished annular edge of the paperboard shell of the sample set forth in FIG. 11 passes further into the concave forming surface before buckling thus resulting in a substantially defect free brim curl. The unfinished annular edge of the paperboard shell of the example set forth in FIG. 12 did not pass fully into the concave region of the forming die and thus buckled at a point less than an optimum distance into the paperboard material and consequently results in a brim curl exhibiting cracks and other failures in its outer surface.

By forming a paperboard container in accordance with the foregoing discussion, a container that can be reliably manufactured at high speeds and which exhibits an annular edge having relatively small radius of curvature and/or which is formed of a relatively heavy paperboard material having a brim curl which is substantially defect free is achieved.

While the invention has been described with reference to a preferred embodiment, it should be appreciated by those skilled in the art, that the invention may be practiced otherwise than as specifically described herein without departing from the spirit and scope of the invention. It is, therefore, to be understood that the spirit and scope of the invention be limited only by the appended claims.

We claim:

1. A method of forming a paperboard container having a prolate rolled toroidal brim, comprising the steps of:

providing a paperboard shell having an unfinished annular edge;

directing said unfinished annular edge into a forming surface of a forming die;

urging said unfinished annular edge into the forming die; and controlling an initial buckling point of said unfinished annular edge of said paperboard shell, such that a substantially crack free prolate rolled toroidal brim is formed.

2. The method as defined in claim 1, wherein said initial buckling position of said unfinished annular edge of said paperboard shell initiates a distance from about 4 to about 8 times a caliper of the paperboard shell from said unfinished annular edge.

3. The method as defined in claim 1, wherein said initial buckling position of said unfinished annular edge of said paperboard shell initiated a distance from about 25% to about 50% of an arc length of the rolled brim to be formed from said unfinished annular edge.

4. The method as defined in claim 1, wherein said paperboard shell includes a size press adhesive in a range of 8 to 20 lbs/3000 $ft^2$ ream of paperboard material.

5. The method as defined in claim 1, wherein said size press adhesive is in an amount in a range of 13 to 20 lbs/3,000 $ft^2$ ream of paperboard material.

6. The method as defined in claim 1, wherein the amount of said size press adhesive is approximately 13 lbs/3,000 $ft^2$ ream of paperboard material.

7. The method as defined in claim 1, further comprising the step of lubricating said forming surface.

8. The method as defined in claim 1, wherein said paperboard material includes a polymer coating.

9. The method ad defined in claim 8 wherein a melting point of said polymer coating is less than 270° C.

10. The method as defined in claim 9, wherein a glass transition temperature of said polymer coating is in a range of −150° C. to +120° C.

11. The method as defined in claim 8 wherein a lubricating agent is added to said polymer coating.

12. The method as defined in claim 11, further comprising the step of treating said paperboard blank with at least one of a corona treatment, a flame treatment and a polyethylene imine treatment to adhere said polymer coating to said paperboard material.

13. The method as defined in claim 12, where at least two of said treatments are used.

* * * * *